US009512997B2

(12) United States Patent
Zettner

(10) Patent No.: US 9,512,997 B2
(45) Date of Patent: Dec. 6, 2016

(54) BURNER SYSTEM AND A METHOD FOR INCREASING THE EFFICIENCY OF A HEAT EXCHANGER

(75) Inventor: Michael Zettner, Gan Yavne (IL)

(73) Assignee: Triple E Power Ltd., Bèer Sheva (IL)

( * ) Notice: Subject to any disclaimer, the term of this patent is extended or adjusted under 35 U.S.C. 154(b) by 1185 days.

(21) Appl. No.: 13/514,144

(22) PCT Filed: Dec. 9, 2010

(86) PCT No.: PCT/IL2010/001043

§ 371 (c)(1),
(2), (4) Date: Jul. 3, 2012

(87) PCT Pub. No.: WO2011/070580

PCT Pub. Date: Jun. 16, 2011

(65) Prior Publication Data

US 2012/0264070 A1 Oct. 18, 2012

(30) Foreign Application Priority Data

Dec. 10, 2009 (GB) ..... 0921660.7

(51) Int. Cl.
*F23D 14/12* (2006.01)
*F23C 15/00* (2006.01)
(Continued)

(52) U.S. Cl.
CPC ..... *F23C 15/00* (2013.01); *F23C 3/002* (2013.01); *F23D 14/12* (2013.01); *F23K 5/007* (2013.01); *F23C 2200/00* (2013.01); *F23C 2205/00* (2013.01); *F23D 14/02* (2013.01)

(58) Field of Classification Search
CPC .... F23C 15/00; F23C 3/002; F23C 2200/00; F23C 2205/10; F23C 2205/20; F23C 2205/00; F23D 14/12; F23D 14/02; F23K 5/007
USPC ..... 431/1, 8, 157, 158, 328, 347, 350, 9; 60/312
IPC ... F23D 14/12,14/02; F23C 15/00, 3/00; F23K 5/00
See application file for complete search history.

(56) References Cited

U.S. PATENT DOCUMENTS 2,644,512 A * 7/1953 Durr ..... F23C 15/00 431/1
2,695,053 A * 11/1954 Durr ..... F23C 15/00 431/1

(Continued)

FOREIGN PATENT DOCUMENTS

JP 59231309 12/1984
JP 59231309 A * 12/1984

OTHER PUBLICATIONS

Panicker et al. (2007) "Experimental Investigation of DDT Enhancements by Shchelkin Spirals", presentation.

(Continued)

*Primary Examiner* — Gregory Huson
*Assistant Examiner* — Daniel E Namay
(74) *Attorney, Agent, or Firm* — Roach Brown McCarthy & Gruber, P.C.; Kevin D. McCarthy

(57) ABSTRACT

The present invention is a burner system that allows 'quasi continuous burning' of fluids at very high temperatures by using controlled continuous pulsing explosions or detonations instead of continuous flow and thus creating pulsing pressure waves that can be easily utilised for increasing heat exchanger efficiency. After initiation the explosions or detonations are maintained by use of infrared radiation. The pulsed explosions or detonations send their shock waves directly onto the heat exchanger walls thus introducing a bigger part of energy into the heat exchanger wall then would be possible with any other method of heat exchange. In addition the kinetic energy of the negative acceleration of the mass in the explosion or detonation wave is added as additional heat introduced into the heat exchanger walls.

14 Claims, 6 Drawing Sheets

(51) Int. Cl.

| | |
|---|---|
| ***F23C 3/00*** | (2006.01) |
| ***F23K 5/00*** | (2006.01) |
| *F23D 14/02* | (2006.01) |

(56) References Cited

U.S. PATENT DOCUMENTS 2,950,592 A * 8/1960 Frank ..... F02K 7/06 431/1
3,151,454 A * 10/1964 Curtis ..... F23C 15/00 431/1
3,606,867 A * 9/1971 Briffa ..... F23C 15/00 122/24
4,382,771 A * 5/1983 Carr ..... F01K 21/047 431/10
4,473,348 A 9/1984 Tikhonovich et al.
4,574,745 A * 3/1986 Belles ..... F24H 1/26 122/24
4,856,981 A * 8/1989 Flanagan ..... F23D 14/60 431/1
5,090,891 A 2/1992 Hemsath
5,131,840 A 7/1992 Zettner
5,249,952 A * 10/1993 West ..... F23G 5/14 110/235
5,285,769 A * 2/1994 Wojcicki ..... F23C 15/00 126/59.5
5,397,232 A * 3/1995 Nishimura ..... F23C 15/00 228/902
5,403,180 A * 4/1995 Chato ..... F23C 15/00 122/17.1
5,456,594 A * 10/1995 Yap ..... F23C 15/00 431/1
5,845,480 A 12/1998 Defreitas et al.
6,016,669 A * 1/2000 Correa ..... C03B 23/043 264/573
6,035,810 A * 3/2000 Movassaghi ..... F23C 15/00 122/24
H001890 H * 10/2000 Parr ..... F23C 15/00 110/7
6,210,149 B1 * 4/2001 Plavnik ..... F23C 15/00 431/1
6,212,988 B1 * 4/2001 Chernyshov ..... B05B 7/0006 89/7
6,336,806 B1 * 1/2002 Paschereit ..... F23D 11/32 431/1
6,343,927 B1 * 2/2002 Eroglu ..... F15C 1/22 239/101
6,464,490 B1 * 10/2002 Chato ..... F23C 15/00 122/24
6,555,727 B2 4/2003 Zettner
6,584,765 B1 * 7/2003 Tew ..... B64G 1/401 60/247
6,584,774 B1 * 7/2003 Stanek ..... F02C 7/22 239/101
6,964,171 B2 * 11/2005 Li ..... F23C 15/00 431/1
2002/0127504 A1 * 9/2002 Neville ..... F23D 14/02 431/1
2002/0185097 A1 12/2002 Ryan, III
2006/0112672 A1 * 6/2006 Razzell ..... F02C 5/11 60/39.77
2006/0282242 A1 * 12/2006 Parsons ..... F02K 3/04 703/7
2007/0015099 A1 1/2007 Wiedenhoefer et al.
2007/0042300 A1 * 2/2007 Movassaghi ..... F23C 15/00 431/1
2007/0106014 A1 * 5/2007 Kanenari ..... C08J 3/205 524/575.5
2008/0209884 A1 9/2008 Denne
2008/0299504 A1 * 12/2008 Horn ..... F02C 7/264 431/1
2009/0084036 A1 * 4/2009 Neumann ..... C10J 3/10 48/197 R
2009/0136798 A1 5/2009 Peters et al.
2009/0165438 A1 * 7/2009 Occhipinti ..... F02K 7/02 60/247
2009/0286189 A1 * 11/2009 Razzell ..... F02C 5/11 431/1
2009/0286190 A1 * 11/2009 Browning ..... F23D 14/04 431/9
2010/0308128 A1 * 12/2010 Hayashi ..... C23C 4/126 239/13

OTHER PUBLICATIONS

Lu et al. (2007), "Experimental studyof a pulse detonation rocket with Shchelkin Spiral".
IPRP CH II of corresponding PCT application—Sep. 10, 2012—8 pages—the IPRP, 34 pages—IPRP text and figures; 11 pages—IPRP claims.
Experimental Investigations on DDT Enhancements by Shchelkin Spirals in a PDE—article; T. H. New et al. AIAA—2006-552, 44th AIAA Aerospace Sciences Meeting and Exhibit, Jan. 9-12, 2006, Reno, Nevada.
Panicker et al.; Development of a Compact Liquid Fueled Pulsed Detonation Engine with Predetonator; (2007).

* cited by examiner

BURNER SYSTEM AND A METHOD FOR INCREASING THE EFFICIENCY OF A HEAT EXCHANGER

REFERENCE TO CO-PENDING APPLICATIONS

Priority is claimed as a 371 of international application number PCT/IL2010/001043, filed on Dec. 9, 2010; which claims priority to Great Britain patent application serial number 0921660.7, filed on Dec. 10, 2009.

FIELD OF THE INVENTION

The present invention is related to the field of burner systems and heat exchangers. Specifically the invention is related to a new design of burner that allows improved transfer of the heat energy produced in exothermic reactions to heat exchangers that are used for steam production and other systems that use heat exchangers to exchange heat energy from one medium into another.

BACKGROUND OF THE INVENTION

For various purposes fuel and air or other compounds are brought to reaction to create free energy in the form of heat. This is usually done with the help of burners or combustion chambers for the combustion part and heat exchangers for the exploitation of the thus gained thermal energy. As an example: in many power stations fuel is burned and hot water or steam is produced from the thermal energy with the help of heat exchangers. The whole system often called "boiler". This steam is then used to drive a turbine in order to produce electricity. An increase in efficiency of such burners and/or boilers—for example for power stations—would lead to a decrease of fuel consumption without decreasing the power-output. An increase of burner-efficiency and/or heat exchanger efficiency or boiler efficiency would lead to an increase of the total efficiency or so called "system efficiency" of such a power station, would save costs, and would decrease the amount of carbon dioxide and excess heat that is created. An increase of burner-efficiency, heat exchanger efficiency and/or boiler efficiency would also allow the use of fuels or compounds with—compared to usual fuel—low energetic value (often incorrectly referred to as 'low calorific value') and result in the same efficiency as high energy content fuels; thus allowing the use of otherwise waste products as fuels.

There are several physical effects that are utilised in the present invention. These effects are then used in certain combinations to achieve the desired result. By explaining these physical effects first, it is much easier to understand this invention. These effects are briefly described below, independently from each other:

Propagation Speed and Speed of Expansion

When two compounds—for example a fuel and oxygen inside air—chemically react the reaction between these two compounds has a certain specific propagation speed. Best known is the specific propagation speed of octane with oxygen in the form of air. It is known as Octane Number 100, and used as a comparison for other similar propagation speeds. The octane number system for gasoline for cars is based on this speed and therefore it is well known from daily use at gas stations. By increasing the pressure of the compounds of the reaction, the propagation speed increases and thus the time to complete the reaction decreases. The propagation speed increases exponentially over the increase of the pressure. In this regard it is the pressure of the compounds at the reaction that is important, not the feeding pressure that has no direct influence on the propagation speed. When the pressure is increased and the reaction time is accordingly decreased, the same amount of energy is released in a much shorter time. If the reaction of two compounds takes—as an example—the time of 0.1 seconds, then the energy is released within this time and accordingly the volume of the compounds or gases created increases in a certain specific time that is related to the specific pressure and compounds. The time that is needed to expand is also specific for each mixture and pressure and will remain the same as often as the reaction takes place with the same parameters of pressure and amount or masses of the reacting compounds. The same compounds will always—under the same pressure and with the same amounts—react within the same time. In the example taken above: 0.1 sec. (Exceptions to this rule are mixtures with high amounts of non-reacting compounds.)

If the volume of a mixture of a fuel gas and air is expanding during a reaction—just as an example from 10 $cm^3$ to 1,000 $cm^3$—in their specific reaction time that also depends on the specific heat capacities, their density, etc. then the gases will expand in a much shorter time when the pressure of the compounds in the reaction is increased. Thus the speed with which the resulting gases—that are formed in a reaction of the compounds—expands during and after the reaction is indirectly proportional to the reaction time and thus also directly proportional to the pressure of the compounds during the reaction.

Increase of pressure will lead to increase of speed of the expanding gases that are formed during and after a reaction of the compounds. If the pressure of the compounds is high enough, the compounds will react so fast that they explode or detonate. The definition of "detonation" is more common than the definition for "explosion". Both—explosion and detonation—refer to a reaction with a speed of the expanding products of the reaction above the speed of sound.

Flame Front Propagation

Usually in a combustion process before they react compounds stream towards the point where they react. This point can be seen as the beginning of the flame. If the compounds are streaming at the same speed (in meters per second) towards the beginning of the flame, then after the reaction away from the reaction point, it looks like the flame is standing still at a certain point to the human eye. In reality, there is a constant flow or movement of the compounds in one direction and the flame front in the opposite direction.

Each mixture of compounds has for each pressure of the mixture its own specific flame speed. If the flame is moving towards the compounds, it is called positive and if the flame front is moving away from the point where the compounds are fed, it is called negative. A negative movement of the flame—usually due to an increase of flow speed of the compounds—leads to a break-up of the flame.

Flame Front Propagation and Reaction Speed of Mixtures

Increasing the pressure of compounds that are able to and are supposed to react increases the reaction speed. With it the speed of flame propagation also increases. As an example a mixture of methane and oxygen increases its reaction speed with pressure. This increase of reaction speed is exponential to the pressure of the reaction. If however the compounds of a reaction are mixed with other compounds that do not or cannot participate in the reaction or form another reaction, then the flame propagation speed will actually decrease. If, considering the example of a chemical reaction between methane and oxygen, there are other compounds—for example the methane is part of a gas mixture of 50 weight percent carbon dioxide and the oxygen is part of natural air, just around 23.151 weight percent—then only around 25 weight percent of the material that forms the total amount of material going to the reaction is able to participate in this reaction. The other compounds are actually hindering the chemical reaction because they are physically in the way between oxygen molecules and methane molecules, preventing them from reaching each other and reacting. By increasing the pressure of the compounds this effect increases and the flame propagation speed decreases. It is also clear that by increasing the pressure of the compounds the density of the buffer material increases and thus becomes less permeable to the compounds that can react chemically. This effect can be compared to fire-protection doors in big buildings that slow down the propagation of a fire, or even hinder it to spread further. Such fire-protection-doors are usually classified according to the amount of time they can delay the spreading of a fire.

Changing Behaviour of Expanding Gases According to their Speed

The terms: expansion, deflagration, explosion and detonation all relate to the behaviour of reacting and thus expanding gases that are usually formed by a chemical or physical reaction of compounds, relative to the speed with which they are expanding. With increasing reaction and expansion speed, the way in which gases expand changes. At relative low subsonic speeds gases expand evenly. Gases that are formed through an explosion or detonation have a different distribution of density In the latter cases, a thin spherical or partially spherical outside layer of the expanding volume—usually referred to as the "shock-wave" or "blast-wave"—has a much higher density than the gases in front of it and especially those behind, as measured relative to the starting point of the explosion or detonation. The gases behind the "shock-wave" are commonly assumed to have a low pressure or vacuum. The pressure of a wave-front from an explosion or detonation on a Wall (when the spherical or partially spherical wave front hits the wall and the mass of the wave front goes through a negative acceleration) is much higher than the average pressure of these compounds at the point of time when the reaction starts. In other words: the amount of energy that is in the spherically or partially spherically expanding gases is not evenly distributed throughout these gases but is highest at the outside, at the "shock-wave-front".

Gas Friction or Fluid Resistance and its Increase over Speed

Friction, also called 'fluid resistance', is created when pressurised gases flow through pipes or systems similar to pipes. This gas friction or fluid resistance increases with exponentially pressure and with speed. This can best be understood as the mechanical collision of molecules or atoms of the gas or fluid passing through the pipe with molecules or atoms of the pipe. The colliding molecules or atoms are thrown back into the stream and create a flow pattern as a result of being thrown back by the collision that disturbs the free flow until they create a blockage. This can be also compared with a multilane highway and cars travelling on this highway in one direction. If a few cars sporadically collide at the outside lanes with obstacles, they will be catapulted back onto the highway and will cause more collisions with following cars. If the speed is increased, the damage is considerably larger. It is clear that a car that smashes into an obstacle at higher speed will therefore be catapulted further back into the stream. Also, when the density—the flow—or number of cars is increased with more cars behind each other, the flow will be more disrupted by such collisions at the borders. Finally, if the highway gets narrower, the interference with free flow will also increase when collisions at the sides of the highway occur. At a certain speed, that is different for each specific gas stream—according to its composition, temperature, and pressure—the gas friction or fluid resistance is so high, that no more gases can pass through the pipe. The gases are then blocked from flowing by gas friction or fluid resistance.

Boundary Layers

At a solid surface, boundary layers can and will form. For example if a stream of gas flows over a solid surface than the molecules of the gas that are closest to the solid surface will change their path of flow—due to the surface structure of the solid material. Also if a hot gas is streaming over a relatively colder solid surface—no matter whether turbulent or laminar—the gas will transfer a part of its thermal energy to the solid surface and therefore change its properties, primarily its temperature and secondarily its density and therefore volume, thus creating a layer with different flow properties—also referred to as a "boundary layer" between the solid surface and the main part of the gas flow. If gases have to transfer heat energy into solids in heat exchangers, these boundary layers create—mostly unwanted—buffers between the solid wall and the main part of the gas stream, thus significantly decrease the efficiency of heat transfer.

Also, if a stream of hot or warm gases is flowing in a turbulent or laminar manner over a relatively cold surface of the heat exchanger the exchange of energy cools the hot gases and thus also changes their flow pattern. It also creates the natural effect that gases that are on the other side of the gases that just exchanged energy with the wall of the heat exchanger are now hotter and therefore again heat up the gases that just exchanged their heat energy with the heat exchanger wall. Thus, the process of heat exchanging by flowing hot gases over relative colder walls of the heat exchanger creates a pattern that leads to a decrease of the energy transfer. The effect of exchange of energy between colder and warmer gases leads to a decrease of efficiency of heat exchange with laminar or turbulent gas streams due to the creation of layers with smaller temperature differences to the next layer.

Another important point is the successive decrease of the temperature difference between the hot gases and the solid surface. A stream of hot gases with a nominal temperature measured in the middle of the hot gas stream has a certain temperature difference to the solid surface. The higher this temperature difference, the higher is the possible heat exchange rate. The boundary layer however creates layers of gases that have already exchanged heat with the solid surface and thus act as buffers of lower temperatures—like insulation—between the hot area of the gas stream and the colder solid surface. Thus the temperature difference between the hot gas stream and the colder solid surface cannot be used for the heat exchange, just the much lower temperature difference between the molecules of the boundary layer—that have a lower temperature than the main gas stream—and the solid surface.

To overcome this effect of the boundary layers, often turbulent streaming of the hot gases is used—instead of laminar streaming. The hot gases are streaming turbulently and can therefore exchange and replace layers that are forming at the boundaries to the solid surfaces. However, using turbulent streaming instead of laminar streaming of hot gases leads to the effect that more time is necessary to perform the heat transfer. This means that the surface that is covered by turbulent streaming is bigger than the surface that is covered in the same time by a laminar streaming. Therefore the active surface where the heat exchange takes place has to be bigger than would be necessary if there were no effects like the boundary layer, and thus the heat is spread over a bigger surface. Therefore, as a direct consequence, the available temperature also decreases and the same amount of energy has to heat up a bigger surface. Even though the net heat transfer is more efficient with turbulent streaming than with laminar streaming, in both cases only a part of the heat can be transferred.

Due to these effects as described directly above it is commonly said that the higher the temperature of the gases that are produced in the combustion or incineration, the better the overall efficiency of the system. This is not because the system depends on the primary temperature of the combustion or incineration but only because the effects described above make it impossible to gain a higher amount of the heat with conventional heat exchangers that depend on streaming—whether laminar or turbulent—of hot gases over solid surfaces.

From U.S. Pat. No. 6,555,727 (Michael L. Zettner) a burner concept is known where the compounds are fed under pressure and react "explosion-like" very rapidly. In this concept the flame does not break off, burning in a discontinuous way, but clearly burns continuously. Burners that operate under pressure have to deal with the problem of a flame front breaking off and many mechanisms had been invented to overcome this problem. For example U.S. Pat. No. 5,131,840 (Michael L. Zettner) presents a method for preventing the break off of the flame front.

So called "Pulse Detonation Engines" have been known for more than 70 years and a few have even been built and tested. The most famous was the "Argus AS 109-014 pulse jet engine" that was used as the engine for the German "V1 flying bomb". It had mechanical valves or shutters to prevent the backwards movement of the wave front of the explosion or detonation and reached around 50 Hz as frequency. It neither utilised the heat nor the friction of the pulsed explosions or detonations. A more modern form is the heavily modified "Rutan Long" type EZ as well as several experiments in connection with the DARPA Falcon project in the military industry in the USA. Also in these cases only frequencies of 200 Hz have been reached and mechanical means are used to control the frequency of the detonations.

From publications like Shchelkin "Gas Dynamics of Combustion" from 1965 or more contemporary publications that refer to Shchelkin e.g.: University of Texas Arlington Panicker, Philip (2007) "Experimental Investigation of DDT Enhancements by Shchelkin Spirals", and University of Texas Arlington Lu, F.K.; Meyers J.M.; Wilson, D.R. (2007), "Experimental study of a pulse detonation rocket with Shchelkin Spiral", it is known that there are means to increase gas friction or drag in pulse detonation engines in order to decrease or minimise the back-flow of the wave front. However, these means are not designed to stop the wave front completely and they are also not means to control the pulsing of the detonation. The publication of Philip Panicker shows on slide 15/27 the "3-way Rotary Valve" for feeding and also on the same page above the rotary valve spring operated back-flow valves. The Shchelkin Spiral disintegrates after a very short time due to the fact that it has to stand within the backflow of the wave front of the explosion or detonation and therefore receives extreme negative acceleration and heat from the wave front of the explosion or detonation. These extreme forces destroy the spiral after a few seconds of operation according to the findings of Philip Panicker and the photos he has published in the aforementioned publication. The Shchelkin Spiral sits between the point of ignition and the outlet and thus results in the blocking of a wave front of an explosion or detonation. The task of the Shchelkin Spiral is in no case to create a pulsing effect or to prevent backflow of wave fronts from explosions or detonations.

It is a purpose of the present invention to provide a burner system that allows 'quasi continuous burning' of all kinds of fuels at very high temperatures by using controlled continuous pulsing explosions or detonations to create pressure waves that can be easily utilised for increasing heat exchanger efficiency.

It is another purpose of the present invention to provide a burner system that depends on a break off of the flame and uses the effects of the explosion or detonation that blows out the flame for increased heat transfer into the heat exchanger wall.

It is another purpose of the present invention to provide a burner system that works without any moving parts and or valves.

Further purposes and advantages of this invention will appear as the description proceeds.

SUMMARY OF THE INVENTION

In a first aspect the invention is a burner system for reacting at least two fluid compounds at very high temperatures to produce controlled continuous pulsing explosions or detonations. After pulsing explosions or detonations are initiated, they are maintained by use of directed and controlled infrared radiation.

The burner system of the invention comprises:

a) two or more inlets adapted for introducing at least two fluid compounds that have been preheated and pressurized;

b) one inlet chamber connected to each of the inlets, each inlet chamber adapted to prevent the compound that enters it from mixing with another compound;

c) one long, small diameter friction channel adapted at one end to receive the compounds from at least two of the inlet chambers:

d) one reaction chamber adapted at an inlet end to be connected to a second end of the friction channel in order to receive the compounds that flow through the friction channel;

e) one or more outlet channels adapted to be connected to an outlet side of the reaction chamber in order to conduct the products produced in the explosions or detonations away from the reaction chamber; and f) an ignition system, adapted to initiate the operation of the burner system.

The pressure of the compressed compounds and the internal cross-sectional area and the surface characteristics of the inner surface of the friction channel are adapted to allow fast, free forward flow under pressure of the compounds through the friction channel into the reaction chamber and to create high gas friction for the much faster wave front of an explosion or detonation that takes place in the reaction chamber to prevent the wave front from passing backwards through the friction channel into the inlet chambers. In this way the friction channel is sufficiently blocked against the wave front of the explosion or detonation. This causes the continuous repeated interruption of the flow of the compressed compounds forward into the reaction chamber and allows the build-up of continuous repeating pulses of the compounds under pressure in the reaction chamber. This allows continuous repeating pulsing explosions or detonations to take place in the reaction chamber.

The internal shape of the reaction chamber is configured to reflect and focus heat radiation in a form, determined and thus controlled by the shape of the inner surfaces of the reaction chamber into the path of the compounds streaming into the reaction chamber. This creates specific fields of overlapping infrared radiation having sufficiently high temperature to ignite the compounds at a specific point inside the reaction chamber and thus initiates an explosion or detonation after a specific amount of compounds have entered the reaction chamber.

In embodiments of the burner system of the invention the internal shape of the reaction chamber at the entrance side is conical, in the middle essentially cylindrical, and at the outlet side hemispherical.

Embodiments of the burner system comprise a secondary reaction chamber fitted over the outlet end of a first reaction chamber. The secondary reaction chamber is supplied with at least two preheated and compressed fluid compounds through inlets and friction channels. The first reaction chamber and the secondary reaction chamber are connected together such that the compounds that enter the secondary reaction chamber are ignited by the wave fronts of the hot gases that were formed in a first reaction inside the first reaction chamber and then explode or detonate.

In embodiments of the burner systems at least the part of the external wall of the system that is over the reaction chambers and outlet channels is adapted as a heat exchanger that is surrounded by a medium to be heated by the energy of the pulsing pressure waves created by the explosions or detonations that take place inside the reaction chamber. This energy is transferred on impact of the waves with the internal walls of the reaction chamber through the heat exchanger to the medium.

The burner systems of the invention can be adapted to function as a linear engine by fitting a partially cone shaped expansion chamber at the outlet end of the last reaction chamber. The expansion chamber is provided with inlets adapted to feed a fluid through channels into it and the system adapted such that the energy of explosions or detonations that take place in the reaction chamber or reaction chambers is used to heat the walls of the evaporation chamber thereby to rapidly evaporate the fluid.

In another aspect the invention is a heat exchanger comprising walls that define at least the reaction chambers of at least one burner system according to the first aspect of the invention.

In another aspect the invention is a method of increasing the efficiency of a heat exchanger comprising walls defining a reaction chamber for a combustion reaction. The method comprises the steps of initiating and maintaining controlled continuous pulsing explosions or detonations of at least two pressurized fluid compounds at very high temperatures.

In embodiments of the method of the invention the explosions or detonations are maintained by use of infrared radiation.

In embodiments of the method of the invention the frequency of the explosions or detonations is controlled by adjusting the pressure of the fluid compounds.

In embodiments of the method of the invention a build-up of continuous repeating pulses of the compounds under pressure in the reaction chamber is allowed by adapting the pressure of the compounds and the internal cross-sectional area and the surface characteristics of the inner surface of a channel through which the compounds enter the reaction chamber to allow fast, free forward flow under pressure of the compounds through the channel into the reaction chamber and to create high gas friction for the much faster wave front of an explosion or detonation that takes place in the reaction chamber to prevent the wave front from passing through the channel. This causes continuous repeating interruption of the flow of the compressed compounds forward into the reaction chamber, which sufficiently blocks the channel against the wave front of the explosion or detonation thus allowing continuous repeating pulsing explosions or detonations to take place in the reaction chamber.

In embodiments of the method of the invention the reaction chamber is a component of a burner system according to the first aspect of the invention.

In embodiments of the method of the invention the reaction chamber is a component of a burner system according to the first aspect of the invention including a secondary reaction chamber.

All the above and other characteristics and advantages of the invention will be further understood through the following illustrative and non-limitative description of embodiments—thereof, with reference to the appended drawings. In the drawings the same numerals are sometimes used to indicate the same elements in different drawings.

DETAILED DESCRIPTION OF EMBODIMENTS OF THE INVENTION

This invention deals with a method to burn, combust or otherwise react compounds in order to reach higher temperature of a reaction between two or more compounds, for example fuel and air. At the same time the invention relates to a method of increasing the efficiency of heat-exchangers or systems that are connected to burners or other devices in order to heat water, steam, or other materials from the release of thermal energy. This invention is for the improvement mainly of heat exchangers that are used for steam production but also other systems that use heat exchangers in connection with exothermic reactions to exchange heat energy from one medium into another.

The present invention provides a burner system that allows 'quasi continuous burning' of fluids at very high temperatures by using controlled continuous pulsing explosions or detonations instead of continuous flow and thus creating pulsing pressure waves that can be easily utilised for increasing heat exchanger efficiency. The pulsation of combustion or incineration, as achieved by the present invention, is not related to pulsed detonations or explosions. Natural pulsation of combustion or incineration is the result of the manner in which the flames propagate one molecule after the other or one gas batch after the other. The burner system of the invention is also different from so-called. pulse-detonation-engines in that the system of the invention does not comprise any moving parts and or valves.

Figure 1:
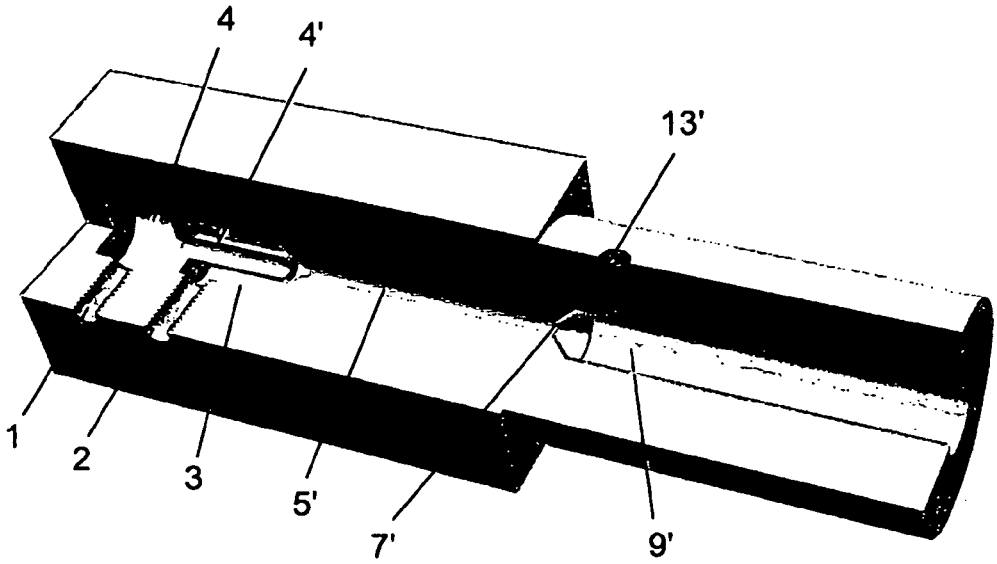
Fig. 1 Prior Art
FIG. 1 schematically shows a basic embodiment of a prior art reaction chamber designed to carry out the method of the invention.

FIG. 1 shows the basic embodiment for the burner system previously described in U.S. Pat. Nos. 5,131,840 and 6,555,727. A quarter of the burner has been cut away along the length to reveal the inner structure. At the left end is an inlet (1) for one of the compounds under pressure, for example a fuel gas. Next to inlet (1) is another inlet (2) for a second compound under pressure, for example air as an oxidizer. Both compounds under pressure are introduced into separate inlet chambers (3) and (4)). An injector needle (4') connected to the front of inlet chamber (4) leads the compound directly into channel (5') and insures that no mixing of the compounds takes place outside of the channel. The compounds under pressure stream through channel (5') and enter the reaction chamber (7') where they are ignited by a spark plug located in the socket (13'). After the compounds under pressure react they form other compounds, which leave the reaction chamber (7') through its open end and exit the burner through outlet channel (9').

Figure 2:
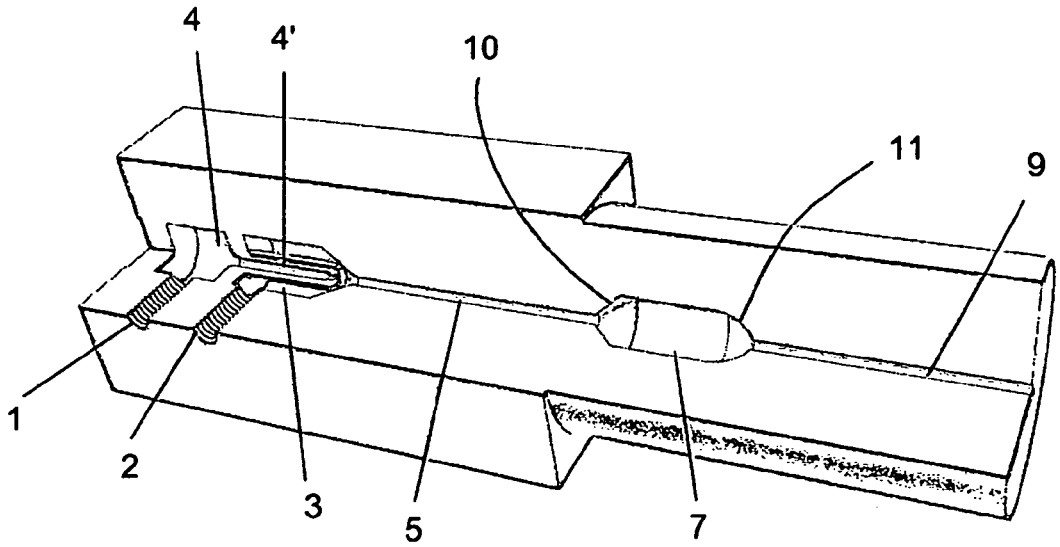
FIG. 2 schematically shows a basic embodiment of the reaction chamber of the invention.

FIG. 2 shows the basic embodiment of the burner system of the invention. The major differences with the prior art burner shown in FIG. 1 are that friction channel (5) is longer and has a smaller diameter than channel (5'), and reaction chamber (7) is now a closed structure that has been given a very specific shape. Specifically, at the inlet side (10) of reaction chamber (7) where it connects to friction-channel (5) the interior walls of the reaction chamber are intentionally given a conical inside shape and at the outlet side (11), where the reaction chamber (7) connects to the outlet channel (9), the inner surface of reaction chamber (7) is given a hemispherical shape. These changes allow the reaction between the two compounds to take place as explosions or detonations instead of as continuous burning as in the prior art. Additionally in the burner assembly of the invention the outlet channel (9) is a thin channel having a diameter similar to that of friction channel (5).

Another difference between the prior art and the burner system of the invention is that, in the present invention, immediately following the detonation or explosion the shockwave front of the explosion or detonation travels partly backwards through the friction channel (5) until increasing gas (fluid) friction stops the shock wave of the detonation of explosion. During this very brief period of time the inlet chambers (3,4) act as "gas springs". The spring effect comes from the interaction of the back-flowing gases pushing on the forward flowing compounds being forced into the inlet chambers. The design of these chambers as well as the pressure of the compounds being fed into the system and the back pressure caused by the explosion or detonation determines the amount of time it takes for the compounds to flow into the reaction chamber again and refill it for the next explosion or detonation, that is they define the time between explosions or detonations and thus the possible frequencies.

Figure 3:
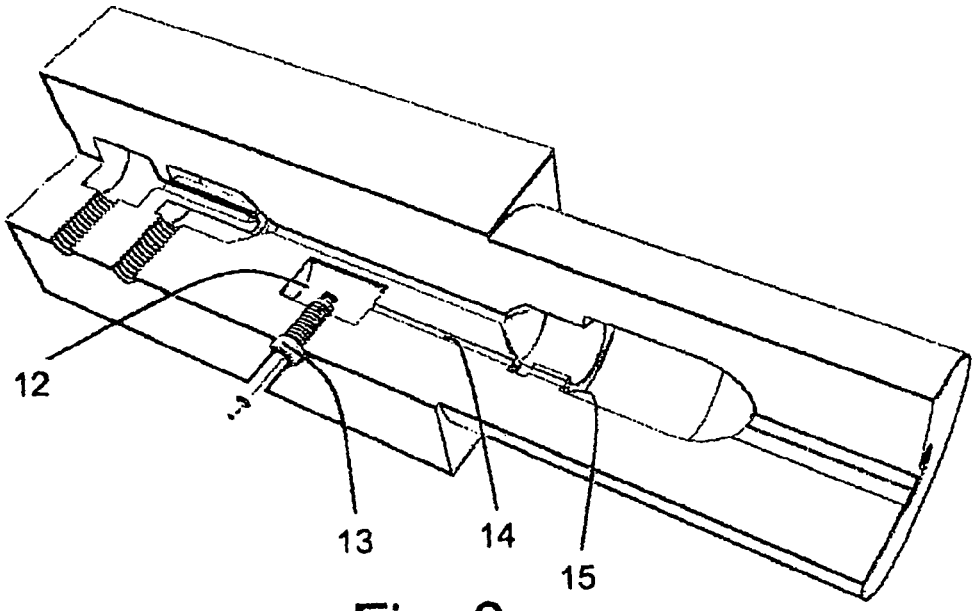
FIG. 3 schematically shows an embodiment similar to that shown in FIG. 2 comprising an additional chamber housing a sparkplug.

FIG. 3 shows a similar embodiment to that shown in FIG. 2. However it has an additional chamber (12) where a sparkplug (13) is mounted in order to ignite the compounds under pressure during the start-up period of the burner's operation. The ignition chamber (12) is connected to the reaction chamber (7) by channels (14) and (15) so that compounds under pressure can also stream into chamber (12) and the ignited compounds back into reaction chamber (7). This or an equivalent arrangement is necessary in all embodiments of the invention in order to initiate the operation of the burner; however it will not be shown in the other figures for clarity.

Figure 4:
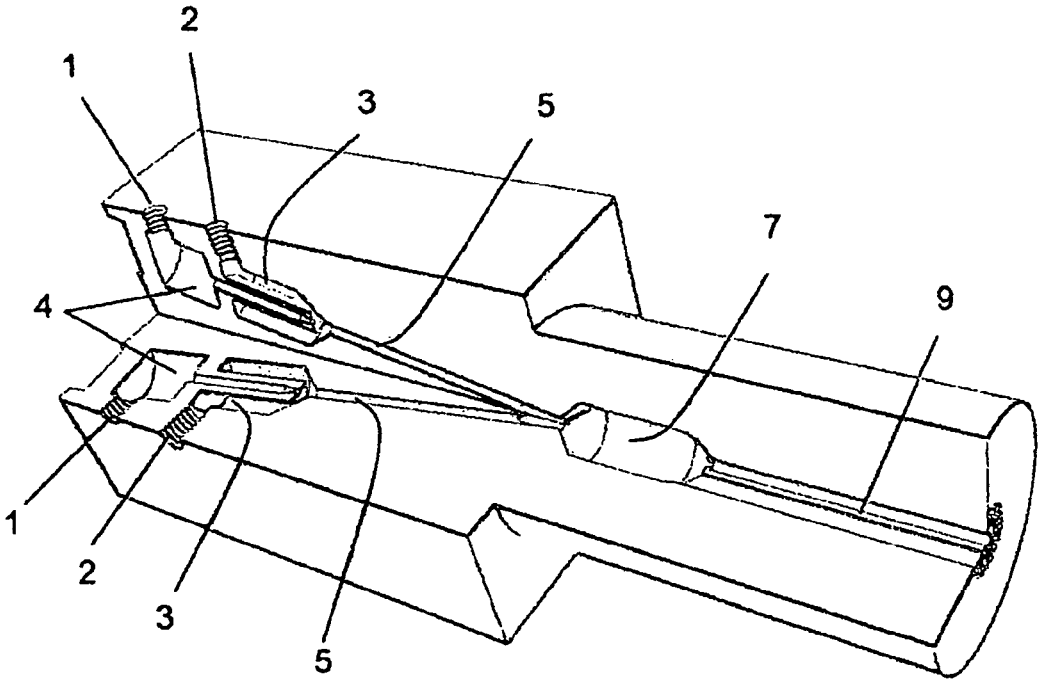
FIG. 4 schematically shows a an embodiment of a reaction chamber comprising a plurality of inlets, inlet chambers, and friction channels.

FIG. 4 shows an embodiment of a burner that has the basic features of that shown in FIG. 2. However, this embodiment of the burner has a plurality of inlets, inlet chambers, and friction channels. In FIG. 4 two of sets of inlets (1,2), inlet chambers (3,4), and friction channels are visible. All friction channels end in the same reaction chamber (7).

Figure 5:
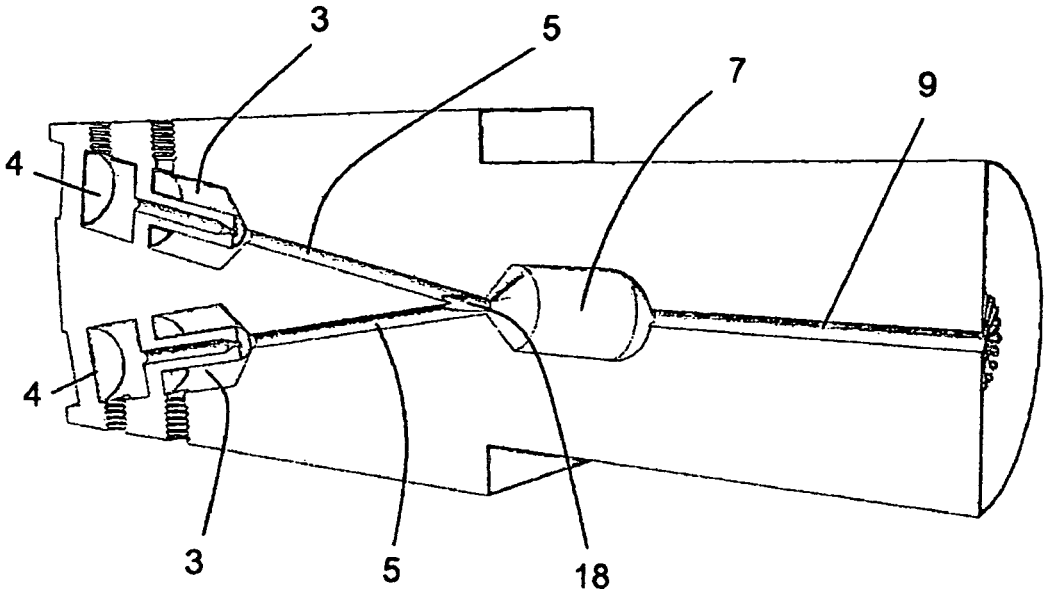
FIG. 5 schematically shows a similar embodiment to that shown in FIG. 4 demonstrating how the distance that a shock wave from a detonation or explosion can travel backwards through the friction channels is limited.

FIG. 5 shows a similar embodiment to that shown in FIG. 4. This figure shows how the angle between the axes of the inlet chambers (3,4) and friction channels (5) limits the distance that a shock wave from a detonation or explosion can travel backwards through the friction channels (5) to the relatively small region (18) in which the ends of the two friction channels overlap at the entrance to the single reaction chamber (7). The reason for this is that a shock-wave front can only travel straight. It cannot bend and cannot travel around any curves.

Figure 6:
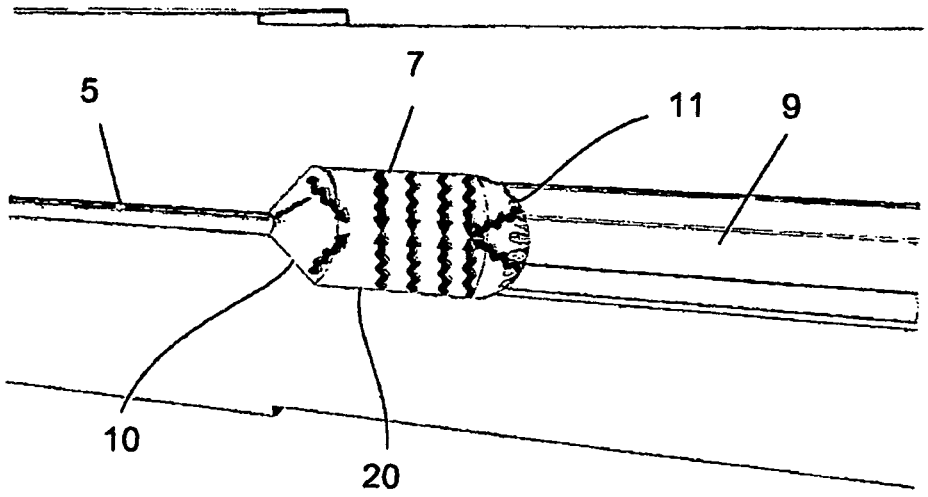
FIG. 6 symbolically shows the effect caused by the special shapes given to the ends of the reaction chamber.

FIG. 6 symbolically shows the effect caused by the special shapes given to the ends of the reaction chamber. The dark wavy arrows represent infrared radiation reflected from the interior walls of reaction chamber (7). At the inlet side (10) the conical surface causes a forward reflection of the radiation. The cylindrical circumferential wall (20) of the reaction chamber reflects the heat as infrared radiation perpendicular to and in the direction of the longitudinal symmetry axis of the reaction chamber (7). At the outlet side (11) the heat is reflected by the hemispherical surface to a focal point inside reaction chamber (7) on its longitudinal axis. The compounds under pressure stream through the friction channel (5) into the reaction chamber along this line of concentrated reflected infrared radiation until the focal point at the middle of the spherical shape of the outlet. As a result of the reflected and focused infrared radiation the compounds are ignited at the focus to start the next detonation or explosion.

Figure 7:
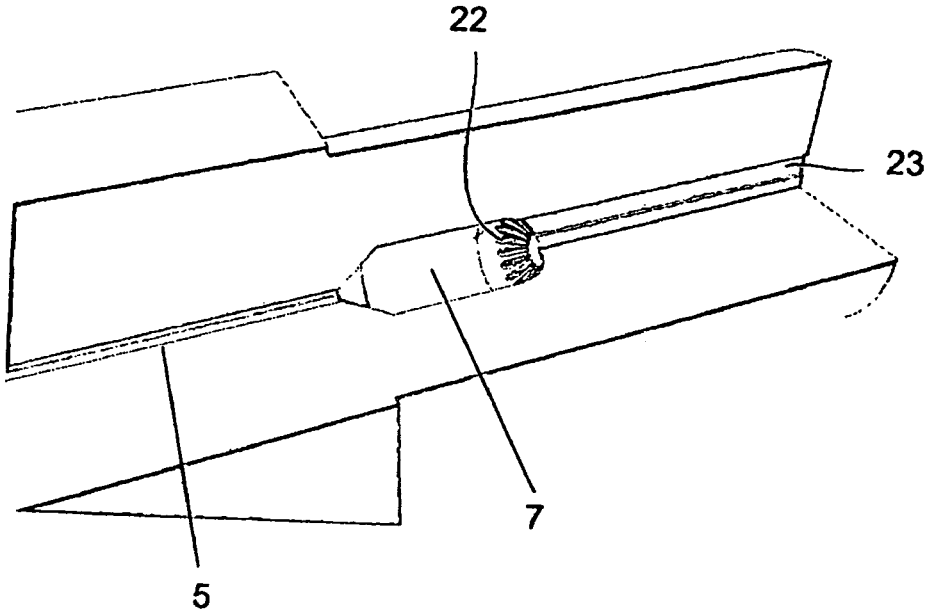
FIG. 7 schematically shows an embodiment of the reaction chamber in which the reaction chamber comprises several small outlet channels FIG. 8 schematically is an end view of the reaction chamber that shows the outlet channels of the embodiment shown in FIG. 7.
Figure 8:
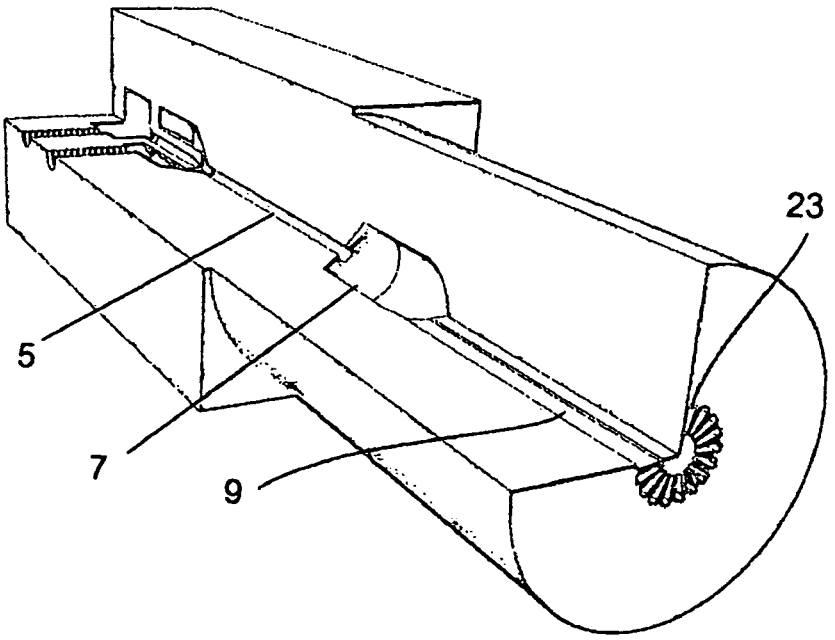
Figure 9:
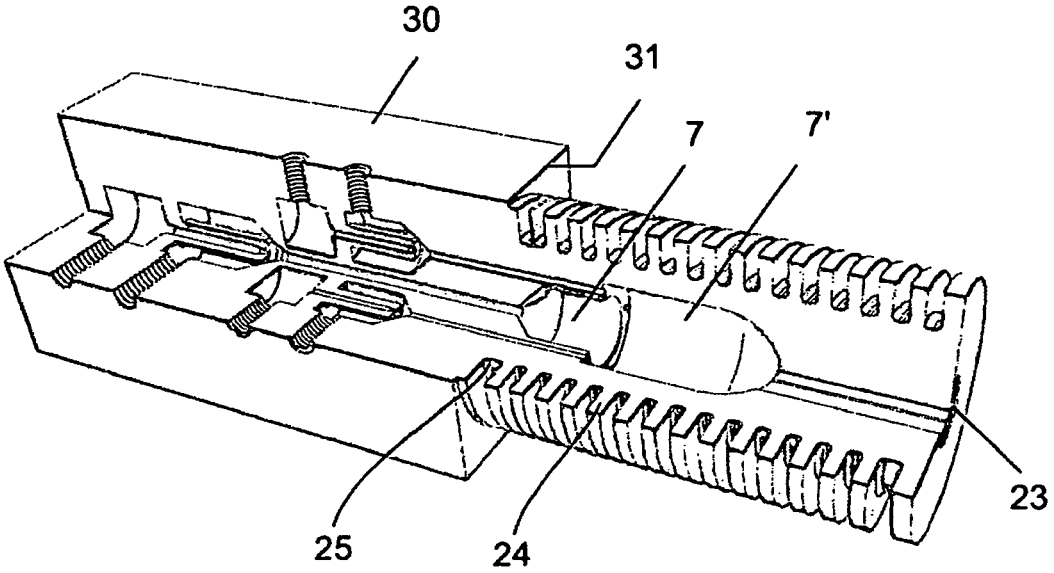
FIG. 9 schematically shows an embodiment of the invention in which a reaction chamber is built into a heat exchanger.

FIG. 7 shows an embodiment of the burner system wherein the single outlet to reaction chamber and outlet channel (9) of the embodiment of FIG. 2 is replaced with several smaller outlets (22) that are each connected to a separate outlet channel (23);

FIG. 8 is an end view of the embodiment shown in FIG. 7 showing the ends of the several outlet channels (23);

FIG. 9 shows an embodiment of the invention, where the outside of the reaction chamber (7) (note that the reaction chamber in this figure is an embodiment that will be described with respect to FIG. 10) and the outlet channels are formed as a heat exchanger to heat, for example, water. A thread like structure (24) allows the water, which would be contained in a casing that is hermetically sealed to the end (31) of the block of material (30) from which the burner assembly and heat exchanger are formed, to run into the gaps (25) between the "threads" enabling the water to come in contact with the outer walls of the reaction chamber (7) and outlet channels. Looking at FIG. 9 makes it obvious how easy it is to incorporate the burner system of the invention into a heat exchanger in which the whole reaction area where the heat is generated is covered with a heat exchanger.

Figure 10:
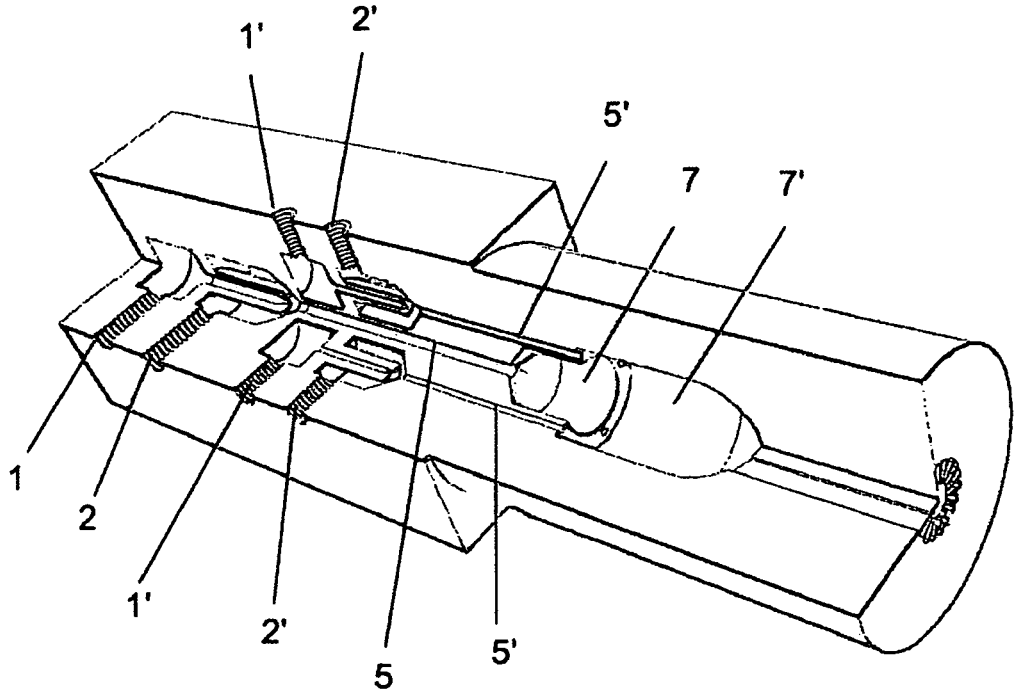
FIG. 10 schematically shows an embodiment of the invention comprising a first or primary reaction chamber which is followed by a secondary reaction chamber.

FIG. 10 shows an embodiment of the invention with a secondary reaction chamber. Inlets (1,2) feed friction channel 5 which leads into primary reaction chamber 7. Reaction chamber 7 is designed as for the previously described embodiments and functions in the same way. Fitted over the outlet end of primary reaction chamber 7 is secondary reaction chamber 7', into which reactant compounds are fed through inlets (1',2') and friction channels (5').

Figure 11:
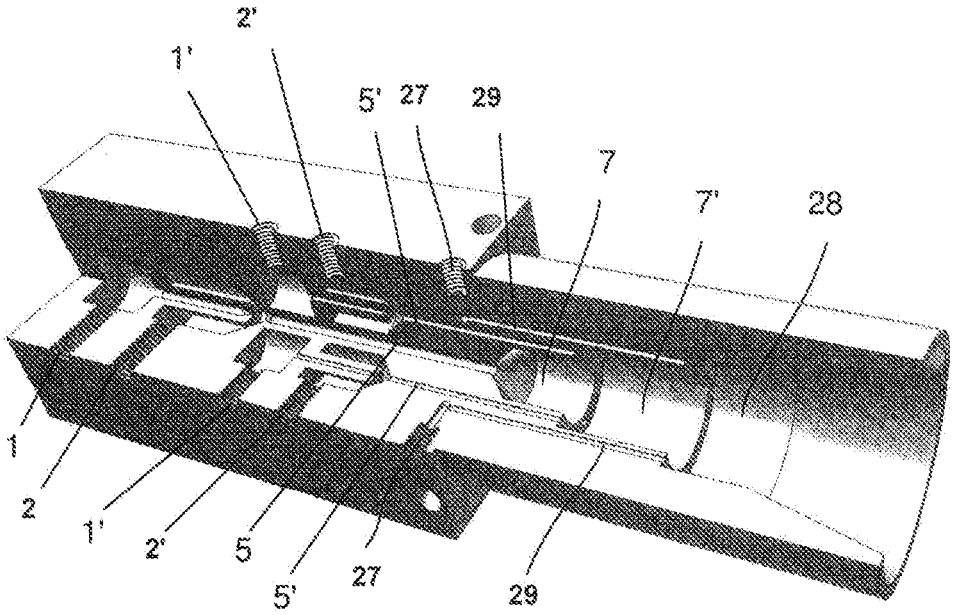
FIG. 11 and FIG. 12 schematically show an embodiment of the invention in which the embodiment shown in FIG. 10 is adapted to be used as an engine.
Figure 12:
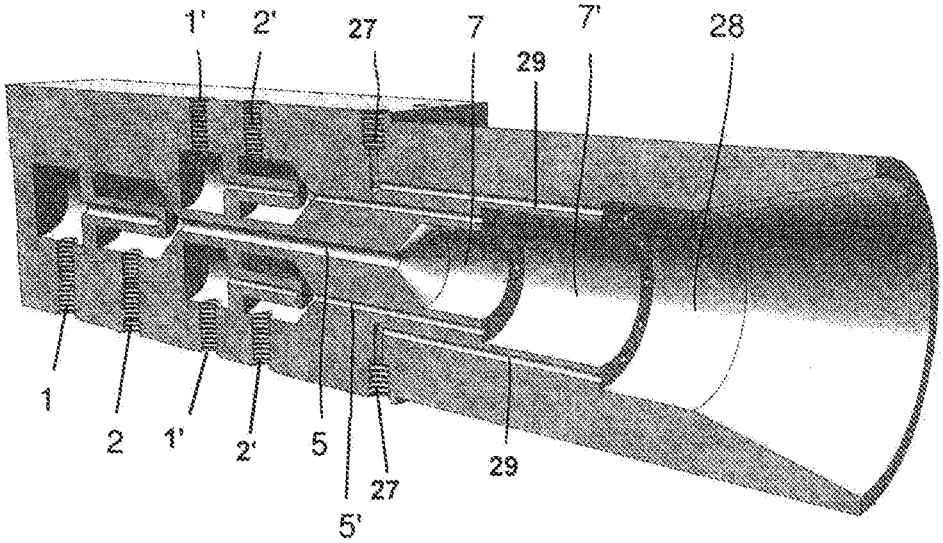

FIG. 11 and FIG. 12 schematically show an embodiment of the invention in which the embodiment shown in FIG. 10 is adapted to be used as an engine. An additional partially cone shaped chamber (28) is fitted over the outlet end of the secondary partial reaction chamber (7'). Inlets (30) are adapted to feed a fluid, for example water, through channels (31) into chamber (28).

Method of Operation

At least two compounds—for example a fuel gas and oxygen or air—are separately compressed. These compounds are then separately pre-heated to enable them to ignite later in the reaction chamber (7) of the burner system. The compounds are then introduced into a chamber called inlet chamber (3, 4) via separate inlets (1) and (2). From the inlet chamber (3, 4) where they are still under high pressure the compounds are forced by the high pressure through a small internal diameter and long conduit, called herein a friction channel (5). Friction channel (5) is a hollow pipe or channel having a cross-section of any shape or geometry. Depending on the manufacturing method of the burner system, it can be formed as a round and straight tube or as a round and straight bore through a block of metal. In the friction channel (5), both compounds mix but don't react. The speed with which the compounds pass through the friction channel (5) has to be high enough to prevent a possible premature reaction. Usually a flow-rate of more then 60 meters per second is easily sufficient because a flame front can travel no faster so that at no point could a flame front travel backwards through the friction channel (5). The pressure of the compressed compounds, the geometry, and especially the cross-sectional area of the friction channel (5) and the characteristics of its inner surface have to be chosen in the right way to optimize these effects of fast free flow under pressure into the reaction chamber (7) without allowing flame fronts to be able to travel backwards by using the high gas friction of the much faster advancing wave-front to prevent compounds from passing backwards into the inlet chamber (3). At the outlet side of the friction channel (5) is the reaction chamber (7) whose interior has a wider diameter and relatively shorter length than the friction channel. In the reaction chamber (7), the mixture is ignited and reacts. During normal operation of the burner the ignition is initiated by means of infrared radiation. At the beginning of the operation and in case of failure of the infrared radiation ignition, a more complicated ignition system is used as described with reference to FIG. 3. The compounds are preheated and under pressure and accordingly react with each other so quickly that they explode or detonate in the reaction chamber with their speed of detonation depending on the pressure of the compounds in the reaction chamber (7). Starting from the centre point of the reaction the explosion—or detonation—wave spreads outwards. Most of the wave front will hit the circumferential wall (20) of the reaction-chamber (7). This is due to the geometrical shape of the inside of the reaction chamber. A much smaller part of the explosion—or detonation—wave will impact the outlet of the friction channel (5) and move into the friction channel against the direction of the compounds that are being pushed into the friction channel from the inlet chamber 3. As said before the cross section of the friction channel (5) is much smaller than the cross section of the reaction chamber (7) or the inlet chamber (3). The geometry of the friction channel (5) is built in a way that allows the compressed compounds to travel through it without any significant friction losses. However, the speed of the explosion—or—detonation front is much higher than that of the compounds flowing towards the reaction chamber and causes so much fluid friction that the explosion—or detonation—front cannot reach the other side of the friction channel (5) but is stopped on its way. By using a curved geometry for the friction channel, this effect can be increased.

Due to its extremely high speed, the wave front of the explosion or detonation can only move straight. By moving extremely fast backwards from the reaction chamber (7) into the friction channel (5) the explosion or detonation wave interrupts the flow of the compressed compounds in the friction channel (5) that are advancing towards the reaction chamber (7). When the effect of the wave front of the explosion or detonation stopping the flow of the compounds towards the reaction chamber (7) wears off, a low-pressure area is left in the friction channel (5) and in the reaction chamber (7) since the wave front of an explosion or detonation has a very high density and is followed by a vacuum-like low-pressure area. The wave front of the explosion or detonation creates a field of intense heat and pressure. This heat and pressure are bound to the mass at the spherical outer side of the wave front. In other words: the energy that is formed by the reaction of the compounds is not evenly distributed in the volume of gases that are formed by the explosion or detonation but is nearly completely concentrated in the wave front of the explosion or detonation. If there were an average temperature that is reached by the reaction of the compounds it also is not distributed evenly. The temperature is much higher at the wave front of the explosion or detonation and lower than the average temperature behind the wave front inside the spherical volume of expanding gases. Thus, the explosion or detonation also functions as a micro-heat-pump that concentrates energy at the wave front and increases the temperature there. This effect creates an artificially high difference of temperature between the circumferential walls (20) of the reaction chamber (7) and the surface of the wave front. Therefore, because of the temperature difference between the wave front and the wall (20), a large part of the heat energy is transferred very rapidly into the circumferential wall (20) of the reaction chamber (7). Since the heat has been transferred to the wall of the reaction chamber, this leads to a decrease of the amount of heat energy inside the gases that were formed during the chemical reaction of the compounds. Thus, because the volume of the formed gases, which is equal to the fixed volume of the reaction chamber (7), stays constant, the pressure in the gases remaining from the explosion or detonation drops further. This pressure drop leads to a pressure difference between the compressed compounds in the friction channel (5) coming from the inlet chamber (3) and the remaining gases in the reaction chamber (7).

The low-pressure volume that is created after a large part of the created energy is transferred into the outside walls (20) of the reaction chamber (7) now sucks new compounds into the reaction chamber that were stopped before by the wave front in the friction channel (5). Thus, a pump (or pulse) mechanism is created. The compounds are continuously fed under pressure into the inlet chambers (3, 4) before the friction channel (5). The gas volume in the inlet chambers acts as a gas-spring and is constantly compressed by detonations and expanded by the following low pressure.

At the side of the reaction chamber (7) that is opposite to the outlet of the friction channel (5), there is the outlet channel (9) of the reaction chamber (7). The gases that had been created by the reaction inside the reaction chamber have this outlet channel (9) as their only exit to leave the reaction chamber (7). The geometry of outlet channel (9) is basically designed similarly to the friction channel (5). It is long and narrow to create sufficient gas friction or drag in the outlet channel (9) to slow down the gases. In accordance with the same physical effects of gas friction, this design will also ensure that the high speed- of the wave front of the explosion or detonation will create so much gas friction that the gases cannot flow through the outlet channel (9) during the explosion or detonation.

Since both openings of the reaction chamber (7) are small and unable to let a shock wave out of the reaction chamber (7) the greatest part of the energy of the chemical reaction has to stay inside the reaction chamber (7). The temperature and pressure will therefore increase to extremely high values. This behaviour of creating an artificial increase of pressure and thus increasing an explosion or detonation is called in the German language: "Eigenverdämmung". A close translation into English would be: "self-encapsulation". This is a well-known phenomenon that is used in the field of explosives. The physical nature of the shock wave of an explosion or detonation is to have nearly all the mass and thus the energy located at the wave front while in the centre areas of the spreading wave there is nearly no mass and thus only low energy.

When the shock wave travels into the friction channel (5), it has a very high speed due to the explosion or detonation. The specific value of the speed depends on the pressure under which the compounds react and the material properties of the compounds, as well the precise geometry and size of the reaction chamber (7). A speed of between 2,000 meters per second to 6,000 meters per second is possible and can be reached without difficulty. Counting from the moment of the explosion, the shockwave front starts to move spherically in all directions also including into the friction channel (5). The time until the shock wave front is stopped is extremely short. If the friction channel (5) has, for example in order to make understanding easier, a length of 100 mm, the reaction chamber (7) a length of 30 mm, and the speed of the explosion is a relative low 1,900 meters per second, than it takes the wave front around 0.000,052,6 seconds to reach the stop-point inside the friction channel (5), where it has lost so much energy due to the built-up of gas friction that it cannot go further. Beside the drag or gas or fluid friction also the loss of energy due to heat-exchange with the walls of the friction channel (5) slows the wave front down significantly. The wave front contains high density mass, high pressure, and high temperature. As a result of contact with the walls of the friction channel (5), which have been cooled relative to the temperature of the shock wave front by the flow of the pre-heated and pressurised compounds towards the reaction chamber, the much hotter mass of the wave front cools down, thus losing energy, and decreasing in volume, pressure and also speed. At its stop point within the friction channel (5) the wave front is too cold to ignite the pressurised and preheated compounds that are coming in the opposite direction. In practice, trial and error will be used to determine which length and diameter of the friction channel is best suited for an individual application.

After the wave front had been stopped, when the mixed compounds under pressure that are being forced from the side of the inlet chambers (3,4) continue to flow at least faster than the specific flame propagation speed or speed of the flame front of the mixture of compounds at the present pressure,—in the above example with a relative low speed of just 60 meters per second—then it takes them less than 0.001,639 seconds to reach the middle of the reaction chamber (7). That means the interruption of the process is at the most around 0.001,692 seconds before a new reaction can start. This allows this process to be repeated as described above with frequencies above 600 Hz. For a frequency above one Kilo Hertz, the speed of the streaming gases in the friction channel (5)—in the given example—has to be above 100 meters per second over a distance of 100 mm. If the diameter of the friction channel (5) were decreased, the gas friction created by the wave front would further increase exponentially. Thus, the distance that the wave front can travel into the friction channel (5) is also exponentially decreased and also the way in which the wave front can reach inside the friction channel (5). If with the same numbers used in the example above the diameter of the friction channel (5) is only decreased by around 0.1 mm the friction would probably double and the length that the wave front can travel backwards into the friction channel (5) would be just around half. Thus the frequency of 610 Hz would increase to 1,230 Hz=1,2 kHz (Kilo-Hertz).

After the wave-front stops moving further backwards into the friction channel (5), the compressed compounds are again forced through the friction channel (5) and reach the reaction chamber (7). In order to have a repeating reaction it is necessary that the compounds are ignited each time at the same speed, i.e. after the incoming compounds reach the end of the reaction chamber. Because they are under pressure, their ignition temperature is higher than for the same compounds at lower pressure. The compressed compounds have to be ignited when they reach about the middle of the reaction chamber (7), not at the entrance (6), where the friction channel opens into the reaction chamber, otherwise there would be only a small amount of mass of compounds that could react. Therefore, the timing of the ignition has to be precise. If—as has been shown in the example above—the time of one single cycle is just around 0.001,692 seconds, than the ignition has to be within a precision that is just a small part of this time. A precision of less than one single millisecond is nearly impossible to achieve with any electronic or mechanical devices today. Therefore this invention uses the infrared radiation of the process for precise ignition.

The beginning of reaction chamber (7) is at the end of the friction channel (5). In the friction channel (5), the compressed preheated compounds are flowing rapidly towards the reaction chamber (7). In the reaction chamber (7) the cross section widens and the compounds react and, after the reaction, stream out through the outlet opening (9). The cross section of the reaction chamber (7) is larger than the cross section of the friction channel (5) and also than the cross section of the outlet (9). At the inlet side (10) of the reaction chamber (7) where the friction channel (5) ends the reaction chamber begins (6) and the cross section has to change from a small diameter to a larger diameter. The enlargement of the diameter is best realized with a conical shape. After the first few reactions, the walls (20) of the reaction chamber (7) will become warm and then hot. Due to the explosion or detonation of the compounds, the amount of energy reaching the walls (20) is much higher than in a usual combustion of the same compounds. Therefore the walls (20) will be hotter, than they would be, if the same compounds were merely combusted. They will therefore also radiate much more infrared radiation then during ordinary combustion. The conical shape of the entrance area (6) causes a forward reflection of infrared radiation away from the entrance of the reaction chamber (7) towards the middle or centre of the reaction chamber (7) depending on the angle of the conical sides relative to the axis. There the infrared radiation will naturally create an area of focused infrared radiation. The physical laws of optics apply and the infrared waves behave exactly the same as visible light waves when they are reflected from shaped mirrors. What is different however and of great importance is that the infrared radiation continues for some time after the production of heat ceases. While the reflection of visible light from a mirror will stop nearly immediately (due to the time the light needs to travel it is not exactly at the same instant) when the light source for the reflection is switched off. The infrared radiation will continue to radiate even when the reaction is interrupted or ended. By still radiating—after the reaction has stopped due to the wave front pushing backwards into the friction channel (5) thereby interrupting the flow and further reaction—the infrared radiation is reflected and focused and thus able to ignite the gases that follow after the wave front has run out of energy in the friction channel (5) and new fresh compounds reach the reaction chamber (7). To stay with the example above: the infrared radiation has to bridge a time gap of 0.001,692 seconds at a low speed and less than 0.000,846 seconds with higher speed of the gases in the friction channel (5). That is less than one millisecond. It is advantageous to design the circumferential walls (20) of the reaction chamber (7) to focus the infrared radiation such as to create a longitudinal field of heat along the centre-line of the reaction chamber (7). Thus, the preheated compressed compounds that enter the reaction chamber (7) receive more heat in the middle while streaming into the reaction chamber (7). At the end of this field of focused infrared radiation the reflected heat from the outlet side outlet (11) of the reaction chamber (7) is added.

The reaction chamber (7) is connected to an outlet (9) channel that has a smaller cross-section area than the reaction chamber (7). Therefore, at the outlet end (11) of the reaction chamber (7) there is a decrease in the cross sectional area. If this decrease of cross sectional area at the outlet (9) were shaped in a hemispherical shape, it would create a focal point or area for the infrared radiation reflected off of it. By designing the reaction chamber (7) with first a conical inlet side (10) and a hemispherical outlet side (11), there is a longitudinal field of focused infrared radiation along the centre line of the reaction chamber (7) that ends in a focus point where the concentration of the reflected infrared radiation is highest. The focal point is the ignition point. Because the ignition takes place in the centre of the reaction chamber (7) the reaction front moves evenly outwards and also the explosion or detonation wave has its starting or central point on the line of focused reflected infrared radiation.

By using the effect of intentionally reflected infrared radiation for re-igniting the explosion or detonation, the compressed compounds ignite and thus react at a chosen point within the reaction chamber (7). Thus it is possible to create a pulsing reaction with high frequency. The design with hemispherical outlet side (11) and conical inlet side (10) to reflect the infrared radiation inside the reaction chamber (7) is just one possible realization of the idea of using infrared reflection to ignite the explosion or detonation. The precise timing of the ignition by infrared radiation can easily be adjusted by varying the speed of the compounds that are forced through the friction channel, the geometry of the friction channel (5) and its length. A higher pressure of the compounds would lead to a higher flow rate in the friction channel (5) and also to a shorter reaction time inside the reaction chamber (7). Thus, also by increasing or decreasing the pressure of the pressurised compounds flowing through the friction channel (5) into the reaction chamber (7) the exact frequency can be adjusted. It is also possible to shape the reaction chamber (7) in such a way that the focal point of the infrared radiation is at a point that allows higher filling volumes—for example with different angles of the conical shaped entrance and end (10).

For the first few seconds of operation of the burner assembly the focused infrared radiation reflection cannot be used for the ignition, because the walls of the reaction chamber (7) are not yet sufficiently heated up to create enough infrared radiation for ignition that is radiated backwards into the reaction chamber (7). An ordinary spark plug (13) that is mounted in the circumferential wall (20) of the reaction chamber (7) would be sufficient to ignite the preheated compressed compounds at the beginning, before the infrared radiation is able to reignite the pulsing mixture. However, if a spark plug (13) were situated in the circumferential wall (20) of the reaction chamber (7), this part of the surface could not be used for heat exchange and also cannot be used for the infrared radiation reflection. Because of the high temperature of the wave front of the explosion or detonation the spark plug (13) or similar device located in the wall of the reaction chamber (7) could easily be damaged or destroyed. Therefore, a better design is to create a small ignition chamber (12) with one or more small channels (14,15) leading from chamber (12) into the reaction chamber (7). Thus, the ignition can be outside the. reaction chamber (7) and all of the heat produced could be realised and used.

The repeated explosions allow the transfer of a larger amount of energy into the walls (20) of the reaction chamber (7), than would be possible with incineration or combustion of the same compounds. From consideration of modern physical explanations for heat transfer by convection it is clear that explosions or detonations form waves with a very dense front of the explosion or detonation wave. By hitting the walls with the wave front any kind of boundary layers or local streaming or eddies is overcome and the wave is only stopped directly by the walls (20) of the reaction chamber (7) itself. When these waves hit the walls (20) of the reaction chamber (7), they not only transfer directly heat from the hot reaction but also create energy in the form of heat by impacting the wall (20) with the mass of the wave front, which contains nearly all the mass of the explosion or detonation. The negative acceleration of this mass of extremely fast gases is changed into heat directly on the surface of the walls (20) of the reaction chamber (7) that stop the explosion or detonation wave.

If the outside walls (20) of the reaction chamber (7) are also the inside walls of a heat exchanger than this burner-heat-exchanger system would have a very high efficiency or the physically highest possible heat exchange rate.

The relevance of this is very great for compounds with relative low energy content. When this invention is used, also low energy content compounds can reach high temperatures. For example: carbon monoxide would also be able to be used as a fuel to reach economic efficiency comparable to usual high-energy fuels. This invention integrates a heat-pump effect in its method that allows end-temperature and heat exchanger efficiency to be controlled by the pressure of the compressed compounds that are fed into the burner system.

In case that compounds with low energy content are used to generate steam or hot water or other forms of heat-transfer media, the temperature that can be achieved with conventional atmospheric combustion in a usual burner is much lower than with an energy rich fuel. If for example carbon monoxide is used as low energy content fuel with air, then the result using a usual atmospheric burner would be not just a lower production of heat energy (in MJ/kg) but also a lower temperature (in K). This lower temperature is difficult to utilise because the temperature difference between the hot gases that are produced during the chemical reaction of carbon monoxide and air on the inside of the burner or reaction chamber and the water or steam on the other side of the walls of the heat exchanger is much lower than the temperature difference would be with an energy rich fuel in the same situation. With the invention presented here, it is now possible to use low energy content fuel and achieve the same and better results in producing steam, hot water, or other forms of heat-transfer media.

If the burner system of the invention is used in connection with a heat exchanger then it is a great advantage to use one single piece of heat conducting material, for example metal, to create the inlet chambers (3,4), the friction channel (5), the reaction chamber (7), and the outlet channel (9) in the interior of the piece of material and to use the outside of this material as walls for the heat exchanger (24). The reaction chamber (7) would then constitute the interior of the heat exchanger and the outer surfaces would be surrounded with the medium that is to be heated.

For use with a heat exchanger a way to form the outlet from the reaction chamber (7) that is more advantageous than the simple opening described in relation to FIG. 2 would be to form it from many openings (22) that would run approximately parallel and increase the surface where the gases are leaving the reaction chamber, as shown in FIG. 7 and FIG. 8. Thus, it will be also possible to use the outgoing gasses for heating the heat-exchanger medium.

It would be a logic extension of the previous discussion to add additional heat exchanger steps at the end of the outlet channels (9, 23) for preheating the compounds before they enter the inlet chambers (3,4). If for example a gas is used as fuel, and this gas is stored under pressure the gas is usually cold and can absorb heat from the outgoing exhaust gases thus keeping more energy within the system and increasing further the efficiency of the system. The outgoing gases can overcome resistance by drag or gas friction if the pressure of the compressed compounds is chosen in such a way that there is sufficient pressure left after the reaction for them to pass through the outlet channel.

The friction channel (5) and the reaction chamber (7) are relatively small. To increase the capacity of the burner it is better to add more friction channels (17) and reaction chambers of the same size than to increase the diameter of the friction channel (5) the effects of the combination of flow-speed, pressure and gas-friction are changed, and the effects achieved in this invention could be lost. Also the ratio between surface area to content would shift and decrease exponentially with linear increase of the cross sectional areas of the friction channels or the reaction chamber. Instead of increasing the dimensions of the friction channels or reaction chamber it is preferable to arrange several burner systems in parallel either next to, above or around each other, for example such that in a cross-section perpendicular to their longitudinal axes the burner systems are located around the circumference of a circle or ellipse. In this way, all of the burner systems are aligned and will end in the same exhaust port.

Another way to increase capacity of the device is to integrate one or more additional burner stages at the end of the reaction chamber. FIG. 10 schematically illustrates such an embodiment. Inlets (1,2) feed friction channel 5 which leads into primary reaction chamber 7. Reaction chamber 7 is designed as for the previously described embodiments and functions in the same way. Fitted over the outlet end of primary reaction chamber 7 is secondary reaction chamber 7', into which reactant compounds are fed through inlets (1',2') and friction channels (5'). The preheated and compressed compounds that enter secondary reaction chamber (7') are ignited by the wave fronts of the hot gases that were formed in the primary reaction inside the primary reaction chamber (7) and then explode or detonate after the primary explosion or detonation.

The secondary reaction chamber (7') is different in several ways from the primary reaction chamber (7). The reaction in the primary reaction chamber (7) depends on the infrared radiation for ignition at an exact time and at an exact location. Therefore, the friction channel (5) for the primary reaction in the primary reaction chamber (7) has to be located and oriented such that the preheated compressed compounds flow through the reflected infrared radiation in order to ignite. Practically this is easiest to achieve with gas flow along the symmetry axis in the middle of the reaction chamber. Because the friction channel (5) is lined up with this axis in order to let the preheated compressed compounds into the field of reflected infrared radiation for ignition, the following explosion or detonation of the primary reaction is able to cause the wave front go backwards into the friction channel (5). The secondary reaction in the secondary reaction chamber (7') is then ignited by the expanding wave front of the primary reaction that moves out of the primary reaction chamber (7) into the secondary reaction chamber (7'). If, for example, the primary reaction chamber (7) has a diameter of 20 mm and a length of 30 mm, the wave front from the example discussed herein above with relative low speed of 1,900 meters per second would ignite and start the secondary reaction after 0.000,01 seconds or 0.01 milliseconds after the primary reaction. In this example, the chosen speeds are very low. These speeds can easily be much higher. In such a case, the time difference between the primary and secondary reaction would be much shorter than 0.01 milliseconds. The friction channels (5') leading to the secondary partial reaction chamber (7') step can be positioned away from the centre of the explosion or detonation of the secondary reaction. In this way, the preheated and compressed compounds for the secondary reaction would enter the secondary reaction chamber (7') at an angle to the point of their ignition. Thus, the wave front created by the secondary reaction cannot enter deeply into the friction channel (5') or channels. Therefore the friction channels (5') leading to the secondary reaction chamber (7') can be kept shorter and have larger diameters than the friction channel (5) leading to the primary reaction chamber (7). Therefore larger amounts of compounds can be brought through the friction channels (5') of the secondary reaction chamber (7') than through the central friction channel (5) of the primary reaction chamber (7).

In embodiments of the invention the primary reaction, which takes place using, for example, a well defined and 'standard' fuel in the primary reaction burner (7) can be used as "pilot flame" to ignite a secondary reaction between compounds with varying properties or compositions in the secondary reaction chamber (7').

Other embodiments of the invention comprise more than two stages or combine several multi-stage reaction chambers in rows, circular, or other configurations. The choice of design of the burner device depends upon the application. If for example a non-standard fuel with low energy content has to be used to generate steam, then a relative simple two-stage burner device with a primary reaction using a standard fuel as a "pilot light" and a second stage for the non standard fuel with low energy content would give the best result combining safe operation with largest ratio of surface area to reaction chamber volume for the heat exchanger where the steam is produced.

In designing the burner system, the connection between frequency and heat exchange rate has to be taken into account. Many small explosions or detonations will lead to a higher heat transfer than a single large explosion or detonation. The smaller the amount of mass in one single explosion, the larger the ratio of the mass of the wall surface to the mass of the surface of the wave front of the explosion or detonation; thus increasing the efficiency of heat exchange. With a small mass per detonation or explosion all of the mass situated in the wave front hits the solid surface of the heat exchanger and there would then be no "second row" of the wave front that wouldn't reach the solid surface. Of course, there are also limits beyond which too small a mass of the explosion or detonation does not increase the efficiency of heat transfer any further.

FIGS. 11 and 12 schematically show an embodiment of the invention in which the embodiment shown in FIG. 10 is adapted to be used as a linear engine. In this embodiment an additional partially cone shaped expansion chamber (28) is fitted over the outlet end of the secondary partial reaction chamber (7'). Inlets (27) are adapted to feed a fluid, for example water, through channels (29) into chamber (28). Propulsion is the main purpose for this embodiment and not a stationary heat exchanger, as in previously described embodiments. In this embodiment the energy of primary and secondary reactions that take place in reaction chamber (7) and reaction chamber (7') is used to heat the walls of chamber (28) and thereby to rapidly evaporate water or similar compounds or mixtures of fluid that enter chamber (28). As a result the volume of the outlet stream is increased—in the case of the example of water by a factor of over 1,600. In this embodiment the outlet channel (or outlet channels) has to be sufficiently large to allow the combined volumes of the reaction products from the primary and secondary reaction chambers and the gas or vapor produced in the expansion chamber (28) to escape.

It is to be noted that the inventor contemplates many variations on the embodiments described herein. For example, more than two inlets (1, 2) and inlet chambers (3, 4) can be provided to allow three or more compounds to be introduced into the reaction chambers (7, 7') and more than one type of compound can be introduced into expansion chamber 28 through inlets (27).

Although embodiments of the invention have been described by way of illustration, it will be understood that the invention may be carried out with many variations, modifications, and adaptations, without exceeding the scope of the claims.

The invention claimed is:

1. A burner system comprising a reaction chamber and at least one long, small cross-section friction channel through which at least two pressurized fluid compounds flow into said reaction chamber where they react to produce a controlled continuous sequence of pulsing detonations and/or explosions, wherein each explosion or detonation is followed by an interval during which no reaction takes place, wherein:

a) said reaction chamber of said burner system has a shape and dimensions configured such that, after each detonation and/or explosion is initiated:
   i) a small part of the shock wave produced by each detonation and/or explosion is directed towards and travels into said friction channel; and
   ii) the remainder of said shock wave strikes the interior walls of said reaction chamber causing said interior walls to emit infrared radiation, which is directed towards and focused by design at selected locations within said reaction chamber; and b) said friction channel has a shape and dimensions configured such that said small part of the shock wave produced by each detonation and/or explosion that travels into said friction channel and flows in the opposite direction to the flow of said at least two fluid compounds temporarily blocks the flow of said at least two fluid compounds into said reaction chamber thereby creating said interval until friction between said small part of the shock wave and the walls of said friction channel dissipates the energy of said small part of the shock wave in the friction channel whereupon the pressure of said at least two pressurized fluids and the vacuum created behind said shock wave of the explosion or detonation travelling in said friction channel causes said at least two fluid compounds to resume flowing into said reaction chamber, where said at least two fluid compounds pass through emitted infrared radiation until they reach the designated ignition point whereupon said focused infrared radiation ignites said two compounds.

2. The burner system of claim 1 comprising:

a) two or more inlets adapted for introducing at least two fluid compounds that have been preheated and pressurized;

b) an inlet chamber connected to each of said inlets, each inlet chamber adapted to prevent the compound that enters it from mixing with another compound;

c) one or more outlet channels adapted to be connected to an outlet side of said reaction chamber in order to conduct the products produced in said detonations and/or explosions away from said reaction chamber; and d) an ignition system, adapted to initiate the pulsed operation of said burner system;

wherein, the at least one friction channel is adapted at one end to receive said compounds from at least two of said inlet chambers; and the reaction chamber is adapted at an inlet end to be connected to a second end of said friction channel in order to receive said compounds that flow through said at least one friction channel.

3. The burner system of claim 2, wherein the pressure of the compressed compounds and the internal cross-sectional area and the surface characteristics of the inner surface of the friction channel are adapted to allow fast, free forward flow under pressure of said compounds through said friction channel into the reaction chamber and to create sufficiently high gas friction for the much faster wave front of an explosion or detonation that takes place in said reaction chamber to prevent said wave front from passing in the opposite direction through said friction channel into said inlet chambers;

thereby sufficiently blocking said friction channel against the wave front of the detonation and/or explosion;

thereby causing the continuous repeated interruption of the flow of said pressurized compounds in the direction towards the reaction chamber thus allowing the build-up of continuously repeating pulses of said compounds under pressure in said reaction chamber, which allows continuous repeating pulsing detonations and/or explosions to take place in said reaction chamber.

4. The burner system of claim 3, wherein the internal shape of the reaction chamber is configured to reflect and focus heat radiation in a form, determined and thus controlled by the shape of the inner surfaces of said reaction chamber to specific locations including into the path of the compounds streaming into said reaction chamber, thereby creating specific fields of overlapping infrared radiation that heat said compounds and eventually reach a sufficiently high temperature to ignite said compounds at a specific point inside said reaction chamber and thus initiating a detonation and/or explosion only after said reaction chamber has been filled by a specific amount of compounds that have entered said reaction chamber.

5. The burner system of claim 3, wherein the internal shape of the reaction chamber at the entrance side is conical, in the middle essentially cylindrical, and at the outlet side hemispherical.

6. The burner system of claim 1, comprising a secondary reaction chamber fitted over the outlet end of a first reaction chamber, said secondary reaction chamber supplied with at least two preheated and compressed fluid compounds through inlets and friction channels, wherein said first reaction chamber and said secondary reaction chamber are connected together such that said compounds that enter said secondary reaction chamber are ignited by the wave fronts of the hot gases that were formed in a first reaction inside said first reaction chamber and then detonate and/or explode.

7. The burner system of either one of claim 2 or claim 6, wherein at least the part of the external wall of said system that is covering and thus confining the reaction chambers and outlet channels is adapted as a heat exchanger that is surrounded by or otherwise in contact with a medium to be heated by the energy of the pulsing pressure waves or shock waves created by the detonations and or explosions that take place inside the reaction chamber that is transferred on impact of said waves with the internal walls of said reaction chamber through said heat exchanger to said medium.

8. The burner system of claim 1, adapted to function as a linear engine by fitting a partially cone shaped expansion chamber at an outlet end of the last reaction chamber;

said expansion chamber provided with inlets adapted to feed a fluid in addition to the at least two pressurized compounds through channels into it and said system adapted such that the energy of explosions or detonations that take place in said reaction chamber or reaction chambers is used to heat the walls of said expansion chamber thereby to rapidly evaporate said fluid.

9. A heat exchanger comprising interior walls that define at least the exterior walls of the reaction chambers of at least one burner system according to claim 1.

10. A method of increasing the efficiency of a heat exchanger, said method comprising:

a) adapting said heat exchanger such that it has a common wall with a reaction chamber of a burner system according to claim 1, said wall functioning as the interior wall of said heat exchanger and the exterior wall of said reaction chamber;

b) causing a flow of at least two pressurized fluid compounds into said reaction chamber;

c) initiating a reaction between said fluid compounds to produce a controlled continuous sequence of pulsing detonations and/or explosions, wherein each explosion or detonation is followed by an interval during which no reaction takes place; and d) preventing the formation of boundary layers at the walls used for transferring heat, which would reduce the performance of the heat exchange process, by causing said detonations and/or explosions to take place at a location from which the wave fronts of the shock waves that are produced by said explosions or detonations will propagate and impact on the interior walls of said reaction chamber;

thereby allowing both heat resulting directly from said detonations and/or explosions and also heat generated by the kinetic energy resulting from the negative acceleration of said wave fronts upon impacting said interior walls to be transferred from said reaction chamber to said heat exchanger through said common wall between them.

11. The method of claim 10, wherein the detonations and/or explosions are maintained by use of infrared radiation.

12. The method of claim 10, wherein the frequency of the detonations and/or explosions is controlled by adjusting the pressure of the fluid compounds.

13. The method of claim 10, wherein a build-up of continuously repeating pulses of the compounds under pressure in the reaction chamber is realized by adapting the pressure of said compounds and the internal cross-sectional area and the surface characteristics of the inner surface of a channel through which said compounds enter said reaction chamber to allow fast, free flow under pressure of said compounds through said channel into said reaction chamber and to create sufficiently high gas friction to prevent the much faster wave front of an explosion or detonation that takes place in said reaction chamber from travelling in the opposite direction through said channel; thereby causing continuously repeating interruption of the flow of said compressed compounds forward into the reaction chamber, which sufficiently blocks said channel against the wave front of the detonation and/or explosion thus allowing continuous repeating pulsing detonations and/or explosions to take place in said reaction chamber.

14. The method of claim 10, wherein the reaction chamber is a component of the burner system of claim 1.

* * * * *